US011427388B2

(12) United States Patent
Smith-Phillips et al.

(10) Patent No.: US 11,427,388 B2
(45) Date of Patent: Aug. 30, 2022

(54) UNIVERSAL BEVERAGE CONTAINER COVER

(71) Applicants: Rosalyn Smith-Phillips, Belleville, IL (US); Areatha R Polk, Loganville, GA (US)

(72) Inventors: Rosalyn Smith-Phillips, Belleville, IL (US); Areatha R Polk, Loganville, GA (US)

( * ) Notice: Subject to any disclaimer, the term of this patent is extended or adjusted under 35 U.S.C. 154(b) by 0 days.

(21) Appl. No.: 17/220,713

(22) Filed: Apr. 1, 2021

(65) Prior Publication Data

US 2021/0221579 A1 Jul. 22, 2021

Related U.S. Application Data

(63) Continuation of application No. 16/288,103, filed on Feb. 28, 2019, now abandoned.
(Continued)

(51) Int. Cl.
*B65D 51/12* (2006.01)
*B65D 51/24* (2006.01)
(Continued)

(52) U.S. Cl.
CPC ..... *B65D 51/12* (2013.01); *A45C 3/00* (2013.01); *A47G 19/2266* (2013.01);
(Continued)

(58) Field of Classification Search
CPC ..... B65D 51/12; B65D 33/28; B65D 51/245; B65D 2203/02; A45C 3/00; A47G 19/2266; A47G 2400/123
(Continued)

(56) References Cited

U.S. PATENT DOCUMENTS 6,079,855 A * 6/2000 Azeredo ..... F21V 1/06 362/351
2008/0190945 A1* 8/2008 Milnark ..... A47G 19/2211 220/709

(Continued)

*Primary Examiner* — Jes F Pascua
(74) *Attorney, Agent, or Firm* — Singh Law Firm PLLC; Gautam Bir Singh

(57) ABSTRACT

A universal cover for covering all types of beverage containers and an associated carrying case is disclosed. When placed over any beverage container, the universal cover disclosed uses decorative weights made with acrylic plastic gems, crystals or metal, to keep the cover secured in place as well as for keeping it well stretched and snugly placed over the rim of a beverage container. The universal cover also includes a central opening for inserting a straw or a sipping device there-through. The universal beverage cover offers the functionality of creating a cover for containers where typically no lid or cover typically exists as is the case for non-portable beverage containers such as wine glasses, beer or juice mugs, and other crystal-ware used at a restaurant, banquet hall, or another indoor setting. The universal cover disclosed provides a level of protection against pathogens and other contaminants while maintaining the necessary decor and formality of the setting. Embodiments of the invention provide the additional functionality of maintaining beverage temperature for longer periods. The universal cover can be made with fabrics, or faux leather or vinyl type fabric for based on the degree of insulation or durability desired.

8 Claims, 9 Drawing Sheets

Related U.S. Application Data

(60) Provisional application No. 62/637,408, filed on Mar. 2, 2018.

(51) Int. Cl.
*A45C 3/00* (2006.01)
*A47G 19/22* (2006.01)
*B65D 33/28* (2006.01)

(52) U.S. Cl.
CPC ..... *B65D 33/28* (2013.01); *B65D 51/245* (2013.01); *A47G 2400/123* (2013.01); *B65D 2203/02* (2013.01)

(58) Field of Classification Search
USPC ..... 220/709
See application file for complete search history.

(56) References Cited

U.S. PATENT DOCUMENTS

| | | | | |
|---|---|---|---|---|
| 2009/0194538 | A1 | 8/2009 | Hyche et al. | |
| 2009/0294077 | A1* | 12/2009 | Zimmer | A47H 13/04 160/168.1 R |
| 2010/0058529 | A1* | 3/2010 | Decker | E04H 4/103 4/499 |
| 2011/0049153 | A1 | 3/2011 | Marceca et al. | |
| 2013/0134165 | A1 | 5/2013 | Ciccotelli et al. | |
| 2015/0166235 | A1 | 6/2015 | Harding | |
| 2016/0073808 | A1 | 3/2016 | Drogo | |

* cited by examiner

UNIVERSAL BEVERAGE CONTAINER COVER

CROSS REFERENCE TO RELATED APPLICATIONS

The application claims the benefit of provisional patent application Ser. No. 62/637,408, filed on Mar. 2, 2018, by the present inventors which is incorporated herein by reference. The application further claims the benefit of and is a continuation of non-provisional patent application with Ser. No. 16/288,103 filed on Feb. 28, 2019, by the present inventors which is fully incorporated herein by reference.

FIELD OF THE INVENTION

This invention generally relates to covers for drinking containers for beverages and more particularly a cover that can be universally used on a variety of beverage containers having different sizes and brim shapes.

BACKGROUND OF THE INVENTION

Most beverage containers come with their unique covers adapted to fit the container. Generally, plastic snaps are used for all types of paper or plastic cups. Each type of container comes with its characteristic cover. Further, most applications of beverage covers are used in conjunction with beverage containers that are meant for outdoor usage or usage related to travel. What is needed is a universal type cover that does not depend on the type of beverage container.

Often disposable cups use disposable plastic lids designed for use in connection with paper or plastic containers of various types such as beverage cups. Many such closures have been provided by the prior art with a wide variety of techniques for effecting engagement of the lid with the container.

Notwithstanding the provisions of the prior art, there remains a need for an apparatus that can serve as a cover for non-disposable beverage containers, such as beer mugs, wine glasses, soda cups, for which a complementary cover or a lid is generally not provided. Often there is a need for ladies to cover their drinks as they are slowly nursed so as to keep them free of undesirable contaminants and prevent miscreants from slipping in undesirable chemicals or sedatives into their drinks.

In recent years, there has been a rapid rise in drug induced date-rapes. If a person has had too much to drink or is on drugs they can not consent to sex and having sex with them is legally rape. There are certain date rape drugs that render the victim unconscious and limit memory. Rohypnol, GHB, ActiveSeX, Roofies, Ruffles, Roche, R-2, Rib and Rope are all names describing a date rape drug. These drugs are odorless and tasteless and difficult to detect when in drinks or mixed with other drugs. Date rape is the most common form of rape (78%) with 1 in 4 women expected to fall victim to rape or attempted rape before they reach 25. Although women are more often victims of rape, men can also be victims of rape.

What is needed is a barrier or a cover that prevents the drink from getting compromised as the victim looks away, is distracted, or takes a phone call. Furthermore, what is needed is that cover be decorative, having an ostentatious appeal, and further may have an inscription, or a pithy adage, famous quote, or the mascot of sports team, transcribed on the cover. What is needed is a type of beverage cover that can be easily carried in a ladies' purse and used readily and for covering any type of beverage container so that no matter the setting the universal cover can be pulled out and used to cover the beverage container. What is needed is a beverage cover that allows for the drink to be sipped with a straw without the need for removing the cover.

The design of the universal beverage cover is functional and decorative and as such appealing to taste of women. Furthermore, the beverage cover may include team logos, inspirational quotes, or other transcriptions that further enhance their utility and appeal. Additional details are put forth in the next sections.

SUMMARY OF THE INVENTION

Objects of the Invention

It is an object of this invention to provide a universal cover that can be used to cover all types of beverage containers regardless of their shapes and size. The invention is particularly targeted for non-disposable beverage containers, such as beer mugs and wine and juice glasses, or soda cups used inside a restaurant or a bar. Still other objects and advantages of the invention will in part be obvious and will in part be apparent from the specification and drawings.

SUMMARY OF THE INVENTION

The present invention is directed to embodiments of the universal beverage cover shown in FIG. 1 through FIG. 10, with some embodiments of the universal beverage cover shown in FIG. 1 through FIG. 5 and the embodiments of the carrying pouch shown in FIG. 6 through FIG. 8. Another embodiment for weights are stretchable bands that keep the cover over the beverage container as illustrated in FIG. 9 and FIG. 10. As described below, the universal beverage cover and the carrying pouch are integral complements as the carrying pouch prevents the beads and decorative weights from entangling with the other contents in the purse or bag where the universal cover is carried.

By the present invention, a beverage container cover is disclosed and taught whereby the brim of the container is covered by universal cover provided that is held in place by a multiplicity of decorative weights that keep it stretched so as to prevent the cover from falling into the container. Moreover, the weights also help create a tight seal with the brim of the container so as to help maintain the temperature of the beverage in the container by preventing heat exchange through convection. The type of material utilized for making the container further prevents other types of heat exchange through radiation or conduction and therefore maintains the beverage at a desired temperature for longer periods of time. An embodiment of the invention encloses the material in close contact with the container surface through stretchable bands and maintains temperature by creating an insulation layer.

Preferably the shape of the universal cover component is a square since it allows for the decorative weights to be tied to the four corners of a square. However, other shapes are possible as well. Covers can take the shape of a star, a circle, pentagon, a hexagon, or even an arbitrarily shaped mascot. Hooks are provided along the periphery of the cover where the stabilizing weights are detachably or permanently attached. These weights are distributed approximately uniformly along the boundary of the cover so that when the cover is placed on the beverage container the cover will not get pulled to a particular side.

Another object of the invention is to allow the beverage to be sipped without the need to remove the cover. Therefore a central opening is provided in the cover wherein a straw or another sipping device may be inserted to facilitate the consumption of the beverage without the need to remove the cover. The opening can further include gripping tabs to prevent the straw from moving around in the opening. It is preferable that the straw grippers not be too tight since inserting the straw would otherwise cause the stabilizing weights to move and the cover to get undulated.

The universal beverage cover can also include inscriptions including text and graphical logos, or other pithy sayings which can serve as conversation starters or help in marketing a product or an idea. It is an object of the invention to enable dangling weights to also be in the shape of a mascot or similar shapes used for conveying a marketing theme, such as helmet bearing a logo of a sports team. Hanging weights can be designed to be detachable and decorative, or designed to match the decor of an occasion or dress. Logos and inscriptions may also be placed upon the cover itself. Further, the shape of the cover can be made to represent an article, a symbol or a trademark.

The universality of the beverage cover and its decorative and marketing aspects makes it a unique object that individuals may own and carry with them to benefit from the protection of the beverage cover as well as to communicate their position or endorsement. Therefore, a carrying case is integral to the invention since there are somewhat delicate parts and fasteners involved in its construction that would have a tendency of getting entangled when the universal beverage cover is placed in a bag or a purse. The carrying pouch matches with the decorative aspects of the beverage cover and includes a drawstring type closing mechanism with the string running through the neck of the pouch.

The invention accordingly comprises the several steps and the relation of one or more of such steps with respect to each of the others, and the apparatus embodying features of construction, combinations of elements and arrangement of parts that are adapted to affect such steps, all is exemplified in the following detailed disclosure, and the scope of the invention will be indicated in the claims.

BRIEF DESCRIPTION OF THE DRAWINGS

For a more complete understanding of the invention, reference is made to the following description and accompanying drawings, in which.

PARTS LIST

Cover 20
Hanger Hoop 22
Weight 24
Decorative Weight 28
Straw Hole 30
Straw Gripper 32
Logo or Decorative Design 40
Carry Pouch 50
Draw String 52
Universal Container Cover 100

DETAILED DESCRIPTION

Figure 1:
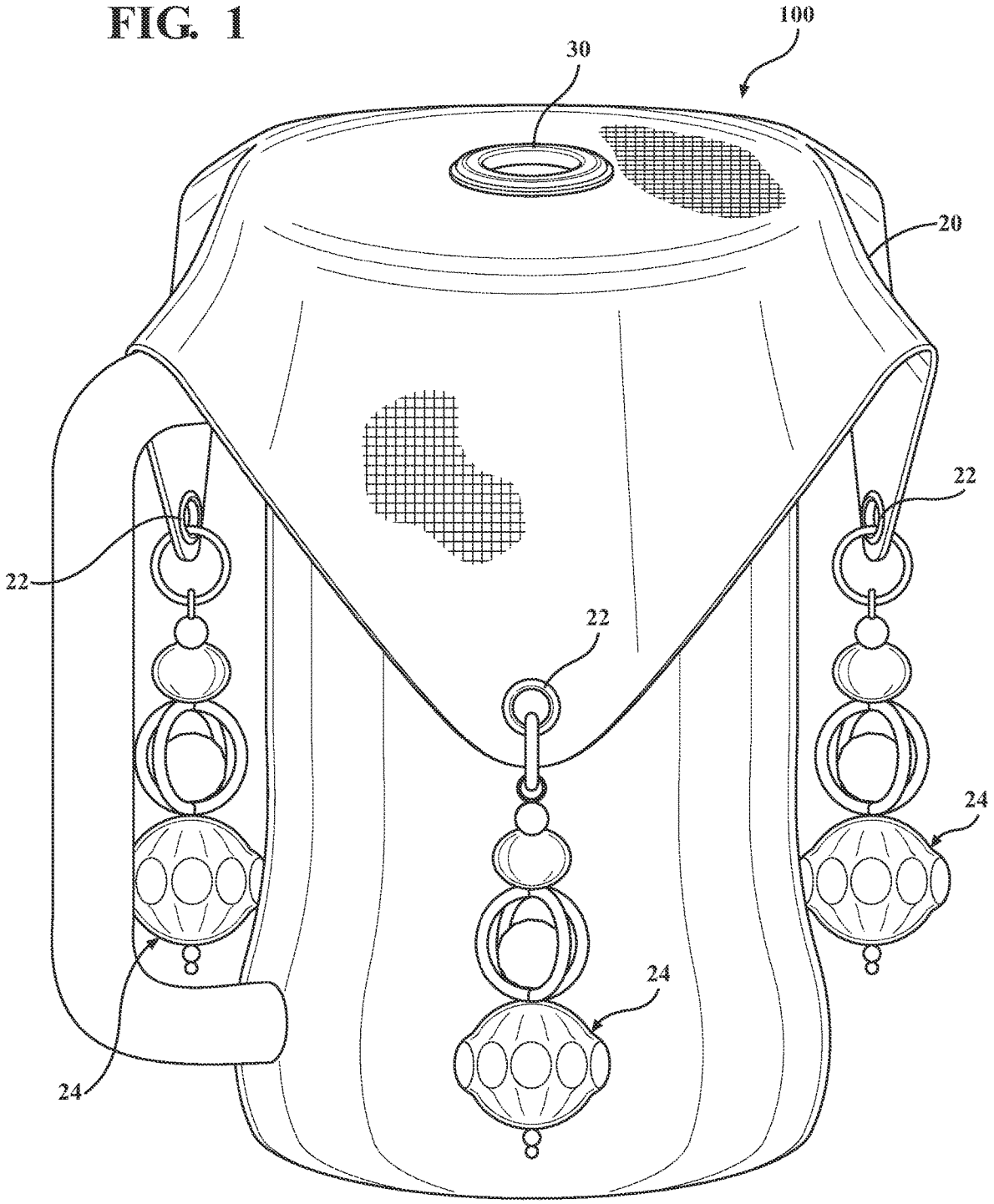
FIG. 1 shows an embodiment of the invention where the universal cover is used over a mug or a cup.

The arrangement in FIG. 1 shows an embodiment of the invention where the universal cover is used over a mug or a cup. As illustrated in FIG. 1 the components of Universal Container Cover 100 are shown. The embodiment shows an exemplary arrangement with Cover 20 placed over a mug. The Cover 20 is substantially shaped like a square in the embodiment shown. The four corners of the Cover 20 include a Hanger Hoop 22, wherein the Hanger Hoop 22 is adapted to fixedly attach to a dangling Weight 24. The purpose of the Weight 24 is to stabilize the cover over the mouth of the beverage container so that once the Cover 20 is placed over the beverage container, it does not easily move. The Cover 20 substantially in its center includes a Straw Hole 30 with a ring enforcement that enables a straw to be inserted therethrough enabling the consumption of the beverage stored in the container without requiring the Cover 20 to be removed.

Figure 2:
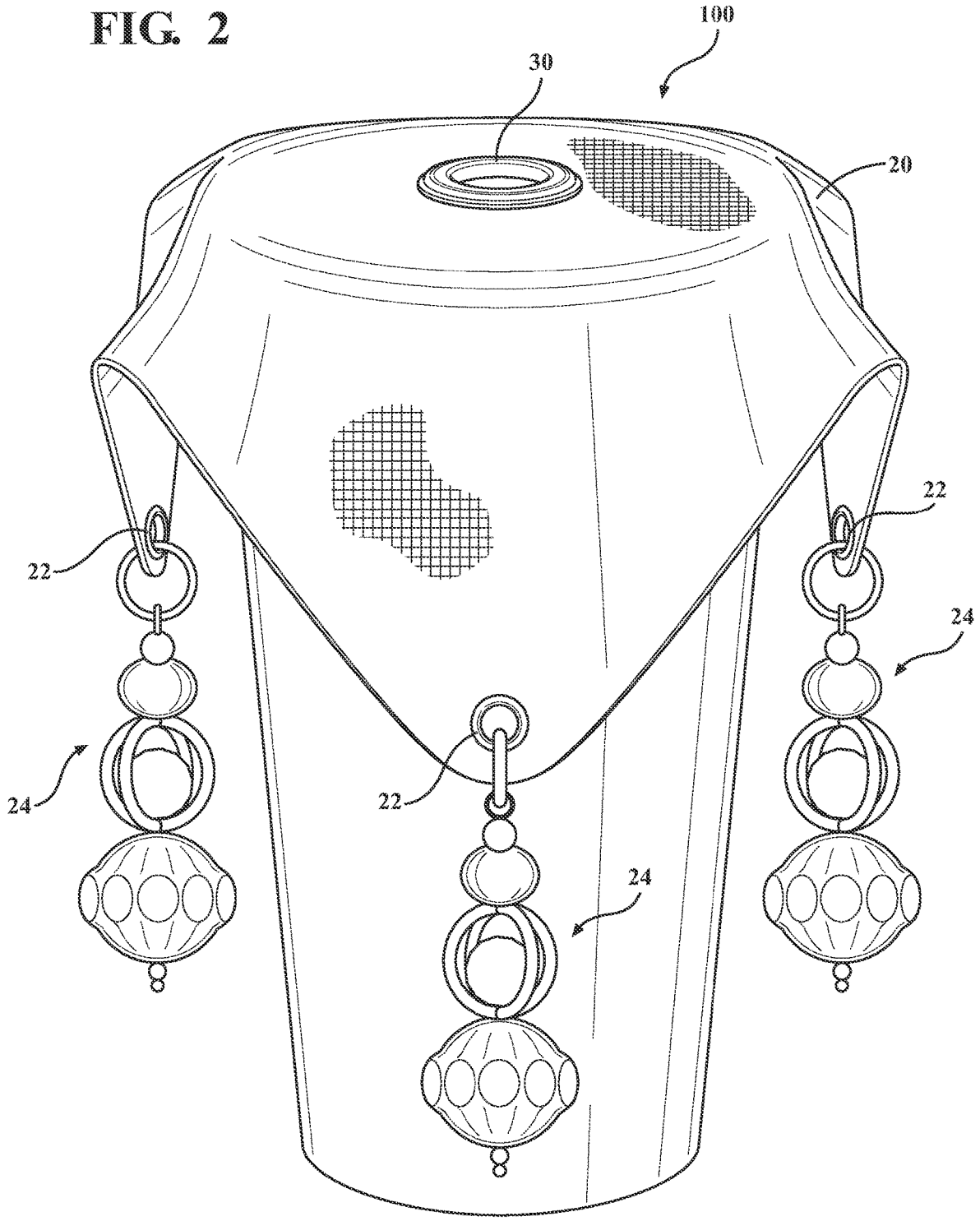
FIG. 2 shows an embodiment of the invention where the universal cover is used over a glass.

The illustration in FIG. 2 shows an embodiment of the invention where the universal cover is used over a glass. In FIG. 2 the Universal Container Cover 100 is used for covering a beverage glass. The embodiment illustrates the versatility and universality of the Universal Container Cover 100, unlike commonly used plastic and other types of lids, the Cover 20 offers flexibility in its ability for use with any type of container irrespective of its size, height, and shape. The Universal Container Cover 100 provides for a plurality of sizes and shape choices of the Cover 20 so as to enable its use on practically any size of container openings. It will be appreciated by a skilled artisan that the Weight 24 attached to Hanger Hoop 22 in an embodiment with larger sized Cover 20 can be increased, for example, to offer added stability. From a functional standpoint, the plurality of Weights 24 prevent the Cover 20 from shifting when a straw is inserted into Straw Hole 30 and potentially moves laterally by the act of its being used for sipping beverage stored in the covered container. An embodiment of the invention includes detachable Weights 24.

Figure 3:
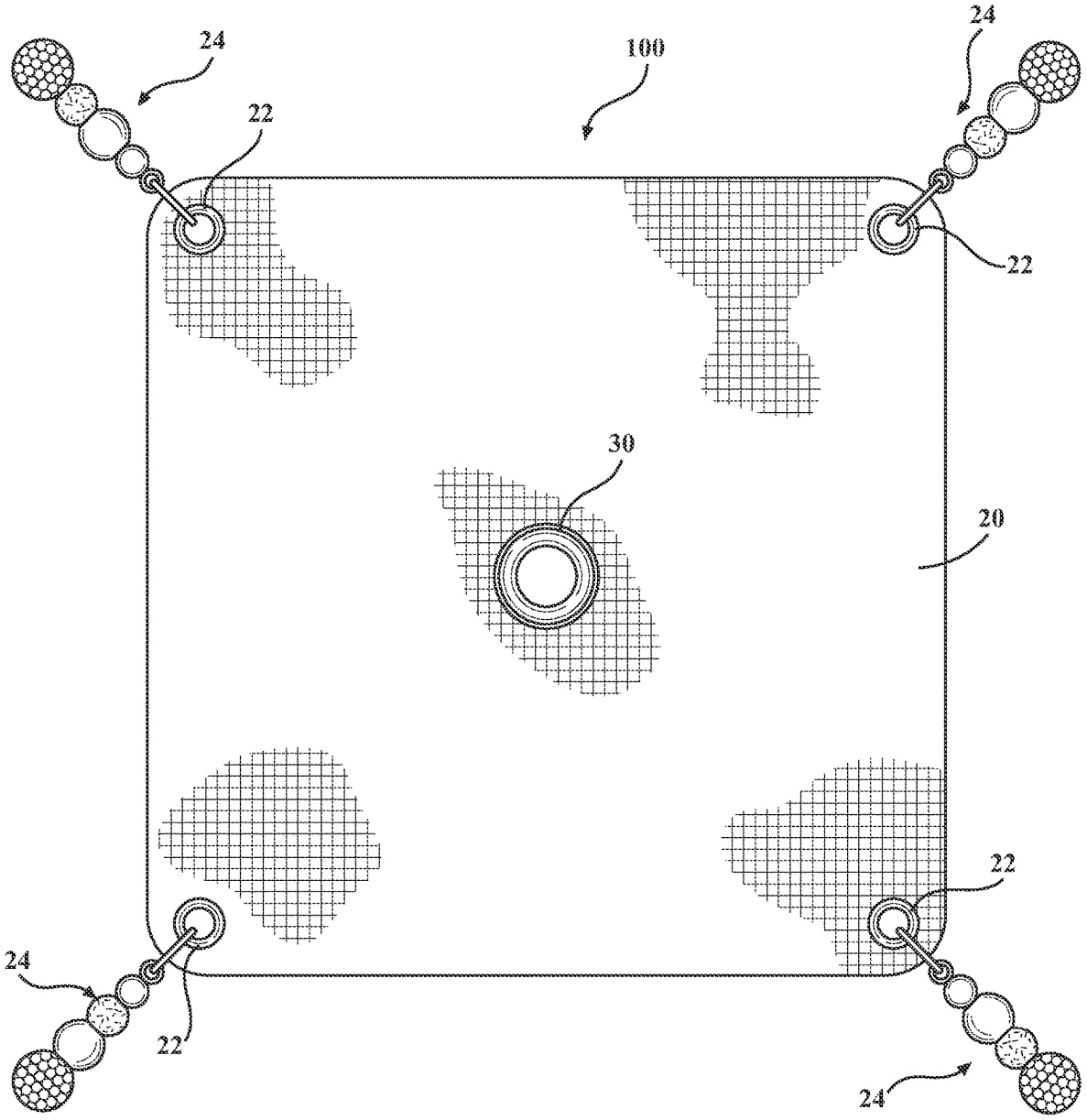
FIG. 3 shows the top view of an embodiment of the invention.

The illustration in FIG. 3 shows the top view of an embodiment of the invention. In FIG. 3 the substantially rectangular embodiment of the Cover 20 has been illustrated. However, this shape is used for illustration purposes only. An embodiment of the invention uses a Cover 20 that is circular, or shaped like a star, or having another non-descriptive arbitrary shape. The embodiments of the Cover 20 include a plurality of Hanger Hoops 22 that are regularly spaced around the periphery of the cover. The plurality of Hanger Hoops 22 are the anchor points to which the plurality of Weights 24 are attached. A skilled artisan will appreciate that a symmetrical placement of the plurality of Weights 24 will enable a counterbalancing of force and prevent the Cover 20 from getting pulled to one side or another. Furthermore, the plurality of Weights 24 generate sufficient lateral tensile forces that keep the Cover 20 sufficiently stretched and allows for easy access to the beverage through the Straw Hole 30.

Figure 4:
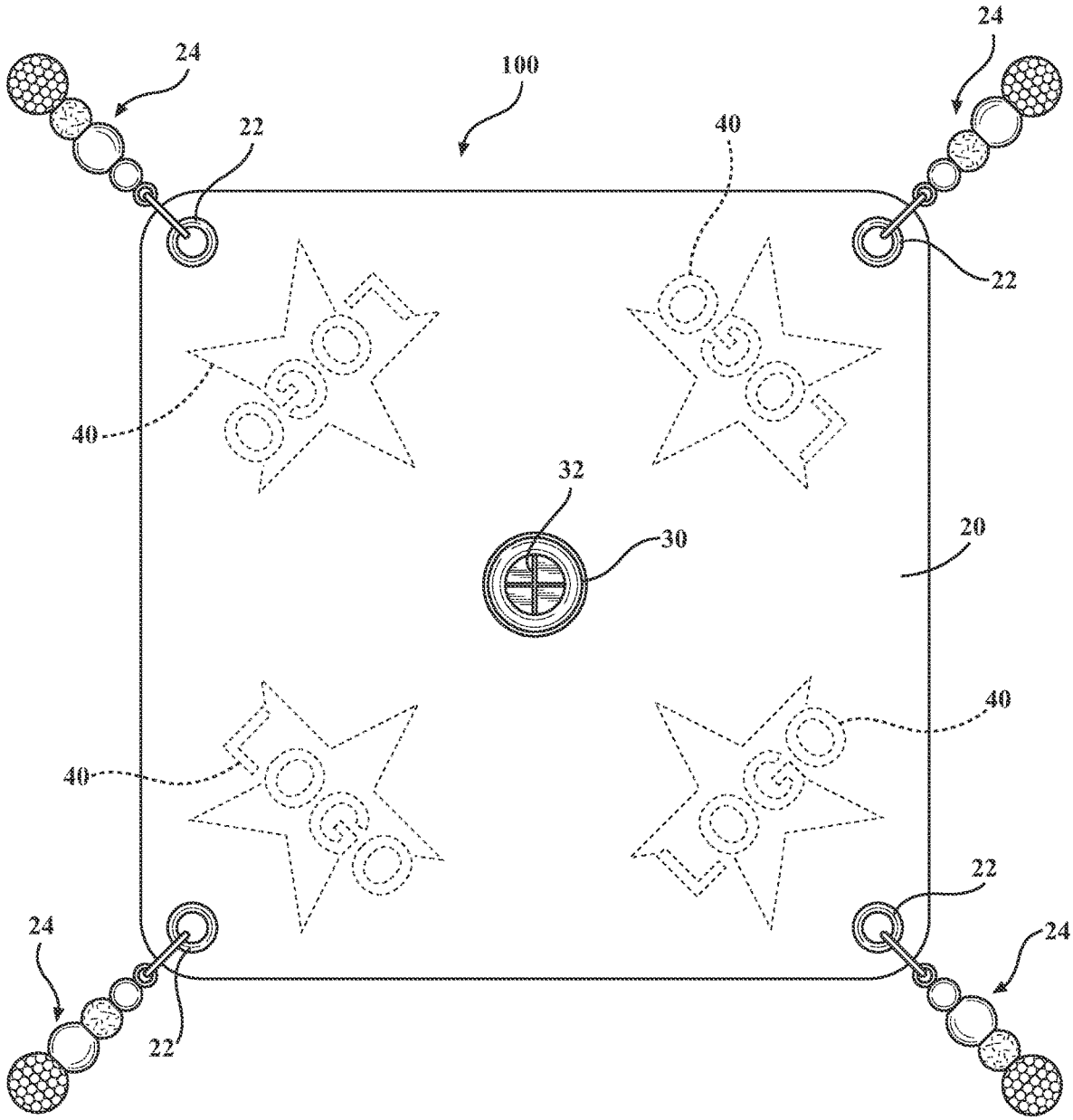
FIG. 4 shows the top view of an embodiment of the invention where the Straw Hole includes a straw gripper, and the Cover includes marketing logos.

The illustration in FIG. 4 shows the top view of an embodiment of the invention where the Straw Hole includes a straw gripper, and the Cover includes marketing logos. The embodiment shows that insignia and letters or other marks may be transcribed on the Cover 20 as Logo or Decorative Design 40. The Universal Container Cover 100 in this manner would thus be associated with a group, a university, an idea, a theme, or a club or the like. The embodiment shown also illustrates the use of a Straw Gripper 32 in the Straw Hole 30 to further secure the straw. It will be appreciated by a skilled artisan that generally the inclusion of a Straw Gripper 32 will need to be such that forces generated by putting the straw will need to counterbalanced by plurality of Weights 24 that get attached to the plurality of Hanger Hoops 22.

Figure 5:
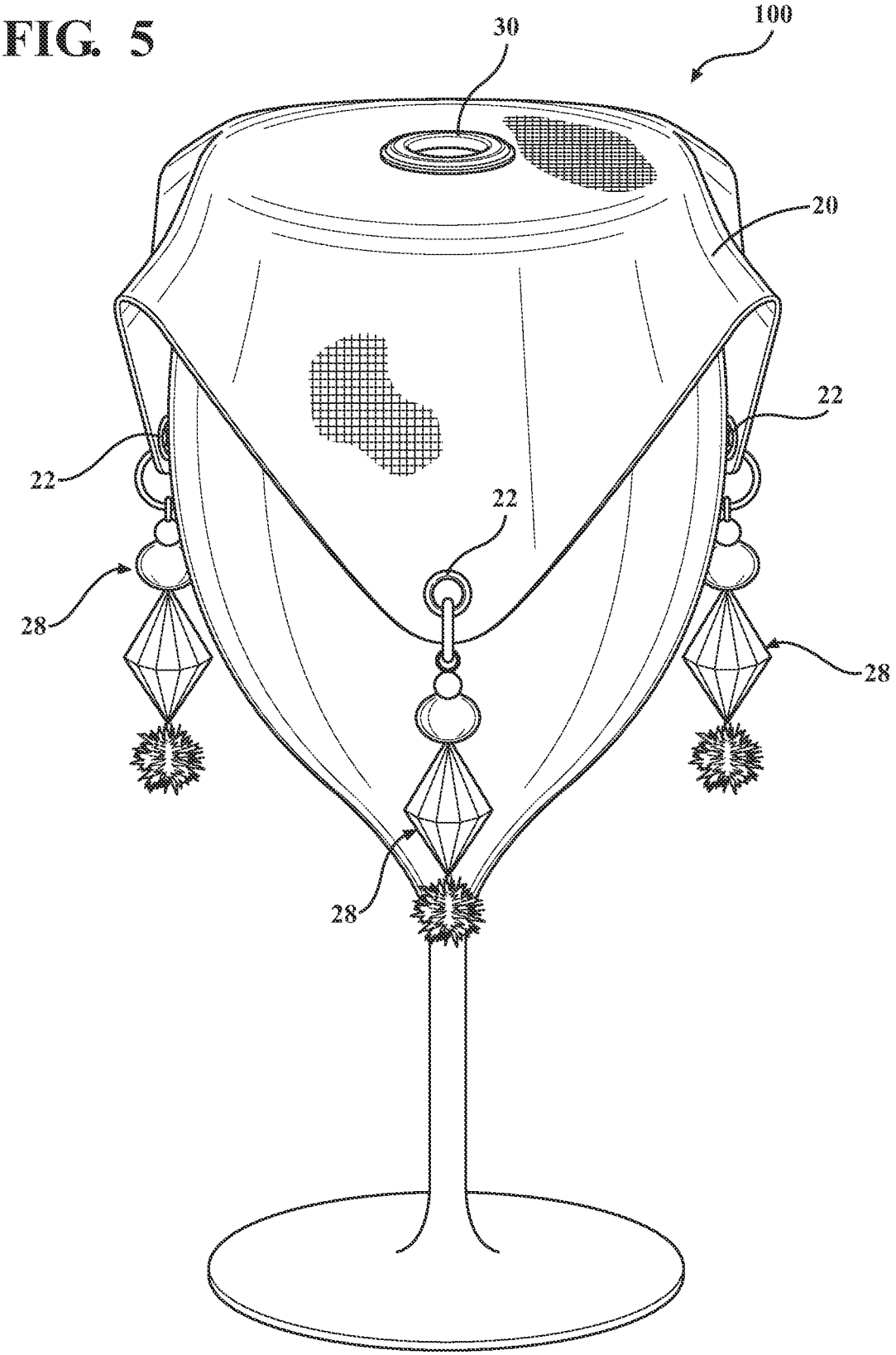
FIG. 5 shows an embodiment of the invention where the universal cover is used over a wine glass where the supporting weights are decorative.

The illustration in FIG. 5 shows an embodiment of the invention where the universal cover is used over a wine glass where the supporting weights are decorative. The embodiment shown uses a Decorative Weight 28. Essentially, this embodiment illustrates that the cover design can be both functional and decorative. Similar to the previous embodiments, a plurality of Decorative Weights 28 are attached to a plurality of Hanger Hoops 22 and provide stability to the Cover 20 and also maintain the Cover 20 in a stretched conformation thereby facilitating the insertion of a drinking straw into the Straw Hole 30. The plurality of Decorative Weights 28 may be detachably attached to the plurality of Hanger Hoops 22 so as to facilitate changing the Decorative Weights 28 for creating a novel impression without the need to carry a multitude of Covers 20.

Figure 6:
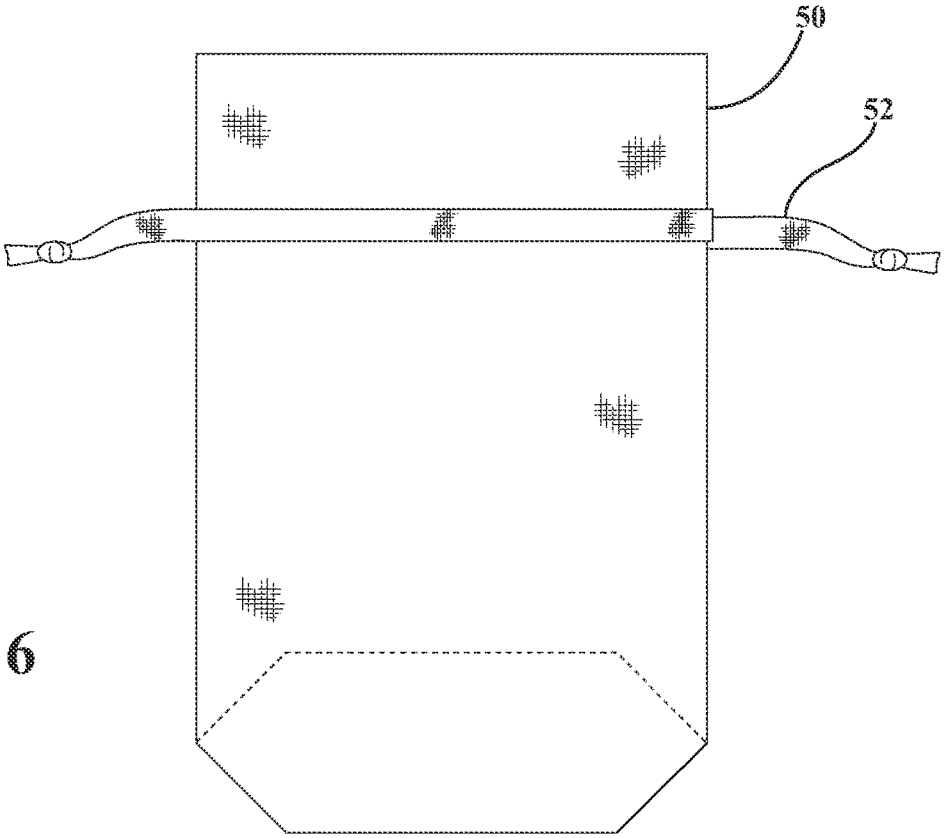
FIG. 6 shows a bag or pouch case adapted to conveniently carry the invention in a ladies purse or handbag.
Figure 7:
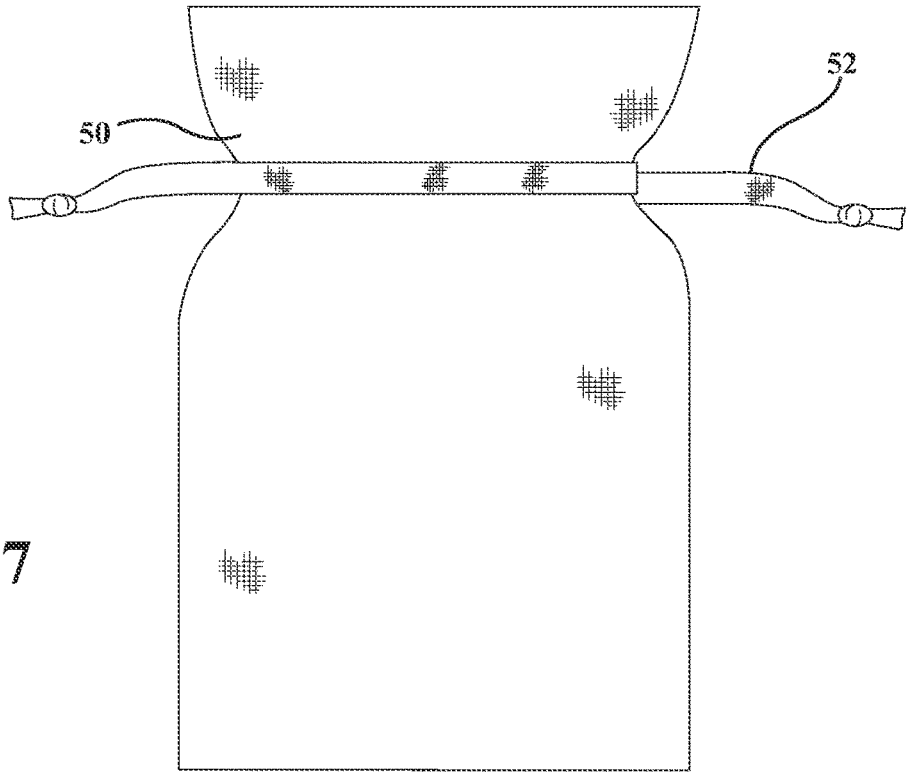
FIG. 7 shows the conformation of the bag or the pouch case where its drawstring has been engaged to close the opening and secure the contents inside.
Figure 8:
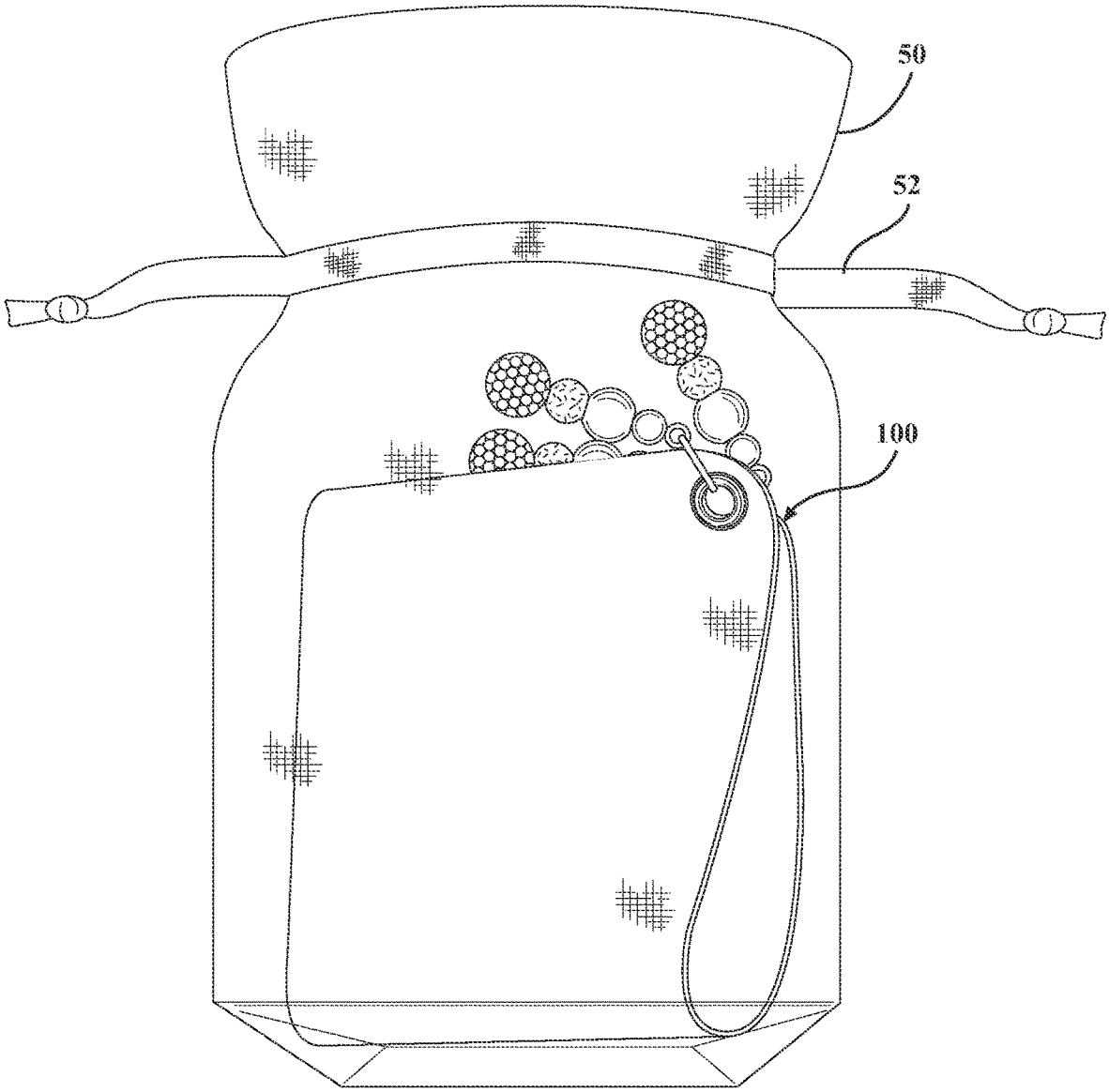
FIG. 8 shows a view of an embodiment of the invention where the Universal Container Cover is enclosed in its see-through bag or pouch case utilizing a drawstring.

FIG. 6 shows a bag or pouch case adapted to conveniently carry the invention in a ladies purse or handbag. FIG. 7 shows the conformation of the bag or the pouch case where its drawstring has been engaged to close the opening and secure the contents inside. Illustrated here is an embodiment for a Carry Pouch 50 utilized for carrying Universal Container Cover 100. Since the apparatus requires that cover and the accompanying weights be properly secured, a closing mechanism Draw String 52 is included therein. Once the string is pulled the mouth of the Carry Pouch 50 closes and secures the contents inside. FIG. 8 shows a view of an embodiment of the invention where the Universal Container Cover is enclosed in its see-through bag or pouch case utilizing a drawstring.

Figure 9:
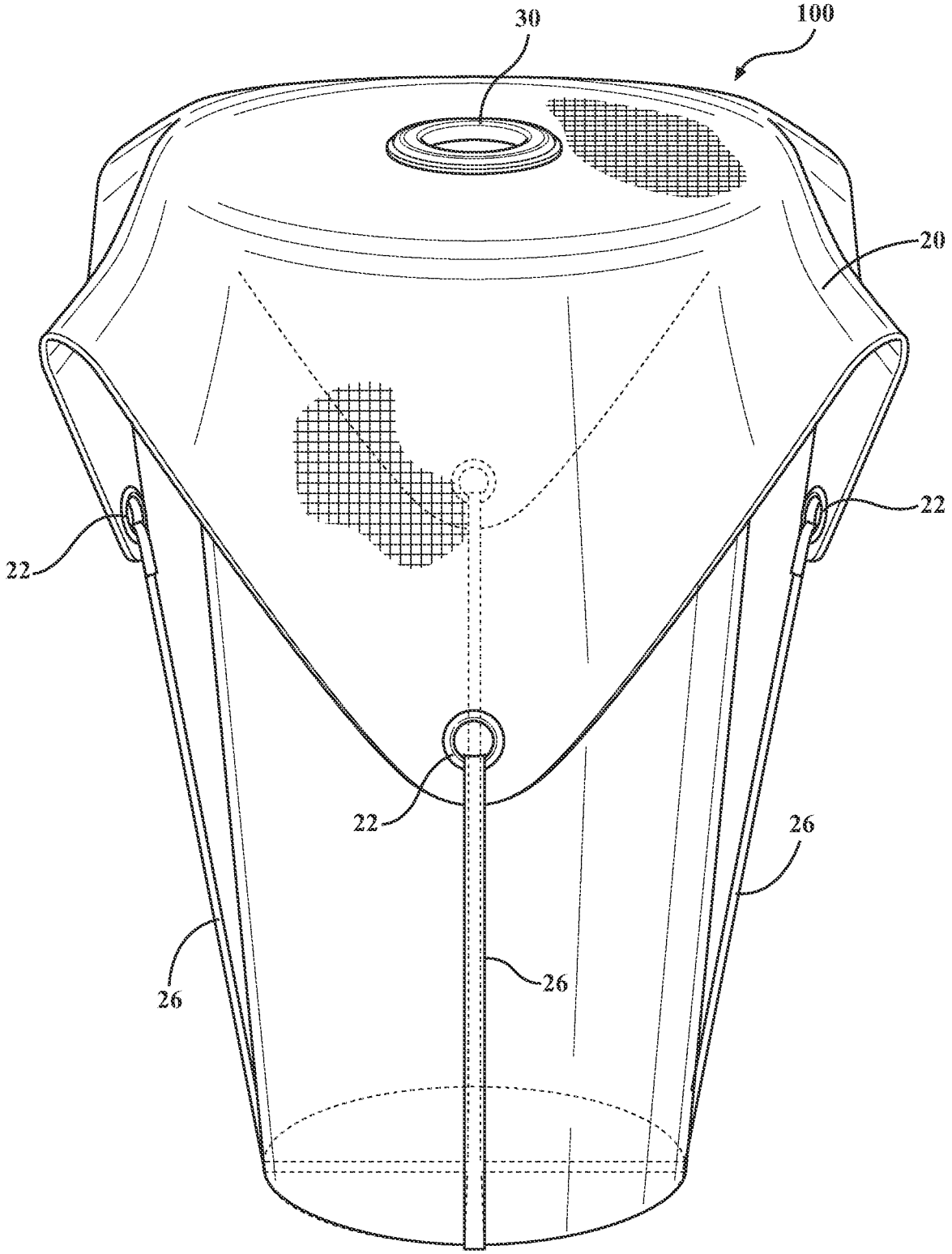
FIG. 9 shows an embodiment of the invention where stretchable bands are used for securing the Cover on to a beverage container.
Figure 10:
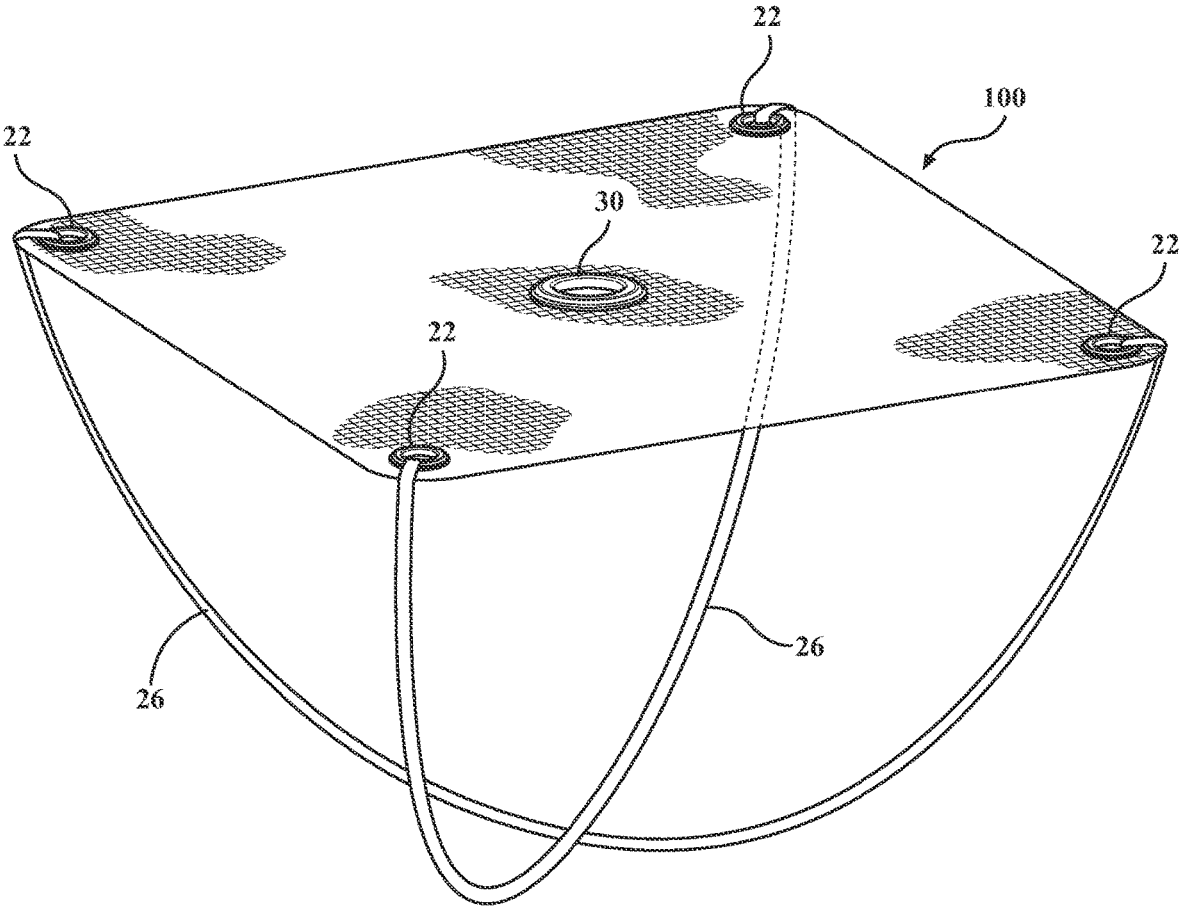
FIG. 10 shows a perspective view of an embodiment of the invention where the stretchable bands are in their relaxed non-engaged state.

The arrangement in FIG. 9 shows an embodiment of the invention where stretchable bands are used for securing the Cover on to a beverage container. As illustrated in FIG. 9 the components of Universal Container Cover 100 are shown where the weights are replaced by plurality of Bands 26 that are stretchable and go across and around the bottom of the container. The embodiment shows an arrangement with Cover 20 placed over a mug with the four corners of the Cover 20 that each include Hanger Hoop 22 with a pair of Hanger Hoops 22 connected by a stretchable Band 26. The embodiment shown helps form a tighter seal between the brim of the beverage container and Cover 20 such as may be needed for transporting a beverage container in a moving vehicle or being used outdoors. An embodiment of the invention causes the hanging weights to snap on to each other to create to create a long stretchable band, further preventing heat loss by maintaining a close contact of the Cover 20 to the outer surface of the container thereby keeping the container insulated. FIG. 10 shows a perspective view of an embodiment of the invention where the stretchable bands are in their relaxed non-engaged state.

It will thus be seen that the objects set forth above, among those made apparent from the preceding description, are efficiently attained and, because certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall there between.

What is claimed:

1. A universal beverage cover for a container comprising:

a covering component having an upper surface, a lower surface, and a boundary wherein the lower surface is adapted for placement over a mouth of the container; the upper and the lower surfaces connect to each other at the boundary wherein the covering component includes a central opening having a second boundary that includes a ring enforcement where the central opening is in communication with the lower surface and the upper surface;

wherein the central opening is configured to having a sipping device inserted therethrough to facilitate beverage consumption without a need for removal of the covering component;

the central opening further including a number of gripping tabs along an internal periphery to confine movements of the sipping device around within the central opening;

a number of hoops spaced equal distant along the boundary such that a distance between adjacent hoops along the boundary measures substantially equal between each of the number of hoops;

a plurality of decorative components that are detachably attached at said hoops, said plurality of decorative components being weighted and configured to stabilize the covering component while in use with the container wherein the weight of the decorative component is configured to keep the covering component distended while it gets subjected to a pressure of insertion as the sipping device is inserted through the central opening;

said plurality of decorative components configured to keep the covering component in a stretched state while in usage with the container so as to prevent the cover from falling into the container.

2. The universal beverage cover of claim 1 further comprising a message, including but not limited to a text or an image that is inscribed on the upper surface of the covering component.

3. The universal beverage cover of claim 2 further characterized by having the covering component further include a pithy adage configured to convey an idea against an introduction of contaminants into the container and a conspicuous inscription is inscribed on the upper surface of the covering component that communicates a message of deterrence configured to prevent drug-induced exploitation of a user of the universal beverage cover.

4. The universal beverage cover of claim 1 wherein the central opening is configured to allow an insertion of a straw for the sipping device.

5. The universal beverage cover of claim 1 where the covering component is selected from a group consisting of fabric, faux leather, and vinyl.

6. The universal beverage cover of claim 1 where the plurality of decorative components are made with plastic gem weights, crystal beads and metallic beads.

7. The universal beverage cover of claim 1 where the plurality of decorative components use hard, acrylic-type plastic beads.

8. A pouch adapted to accommodate the universal beverage cover of claim 1, comprising:

a drawstring closing mechanism with a running through a neck of the pouch where the closing mechanism further comprises an upper surface bounded by upper surface edges wherein the upper surface edges contains an upper edge opening;

a lower surface bounded by lower surface edges wherein the lower surface edges contains a lower edge opening; and wherein the upper surface and the lower surface are fixedly attached to each other along the upper surface edges and the lower surface edges except no attachment exists between the upper surface and the lower surface along the upper edge opening and the lower edge opening wherein the drawstring is inserted at the point of no attachment.

* * * * *